US006721628B1

(12) United States Patent
Lai et al.

(10) Patent No.: US 6,721,628 B1
(45) Date of Patent: Apr. 13, 2004

(54) CLOSED LOOP CONCENTRATION CONTROL SYSTEM FOR CHEMICAL MECHANICAL POLISHING SLURRY

(75) Inventors: Chien-Hsin Lai, Kaohsiung (TW); Juen-Kuen Lin, Kaohsiung (TW); Huang-Yi Li, Tai-Ping (TW); Kevin Yu, Hsin-Chu (TW)

(73) Assignee: United Microelectronics Corp., Hsin-chu (TW)

( * ) Notice: Subject to any disclaimer, the term of this patent is extended or adjusted under 35 U.S.C. 154(b) by 130 days.

(21) Appl. No.: 09/627,865

(22) Filed: Jul. 28, 2000

(51) Int. Cl.[7] ..... G05B 21/00; G01M 1/38; G06F 17/00; H01L 21/461

(52) U.S. Cl. ..... 700/266; 700/1; 700/267; 700/275; 700/239; 700/240; 700/241; 422/105; 422/108; 436/55; 438/5; 438/8; 438/689; 438/692; 438/693

(58) Field of Search ..... 436/55; 451/60, 451/87; 438/85, 693, 689, 692; 700/1, 266, 267, 275, 239, 240, 241; 422/105, 108

(56) References Cited

U.S. PATENT DOCUMENTS 5,407,526 A * 4/1995 Danielson et al. ..... 438/693
5,755,614 A * 5/1998 Adams et al. ..... 451/60
6,183,352 B1 * 2/2001 Kurisawa ..... 451/87
6,257,965 B1 * 7/2001 Kamikubo et al. ..... 451/60
6,323,046 B1 * 11/2001 Agarwal ..... 438/8
6,358,125 B2 * 3/2002 Kawashima et al. ..... 451/60
6,413,151 B2 * 7/2002 Mizumo et al. ..... 451/41

* cited by examiner

*Primary Examiner*—Jill Warden
*Assistant Examiner*—Brian Sines
(74) *Attorney, Agent, or Firm*—Dickinson Wright PLLC

(57) ABSTRACT

Polishing slurry is transported via piping to flow into the closed loop control system. First, the polishing slurry flows into the ultrasonic concentration detector. Original data of the polishing slurry that is determined by means of ultrasonic concentration detector is a fluid velocity at that time. This determined value can be converted into weight percent concentration at that time by memory data table. The converted data of weight percent concentration will be transmitted into program logic controller (PLC), and the data of liquid level volume in the distribution tank will be transmitted into program logic controller at present. The program logic controller will then analyze whether the quantity of oxidant is sufficient. If the quantity of oxidant does not reach the required criterion, the program logic controller will control the analog valve to transmit a supplementary quantity of oxidant into the distribution tank via the analog valve and piping.

18 Claims, 5 Drawing Sheets

$$MnO_4 + 8H^+ + 5e^- \longrightarrow Mn^{+2} + 4H_2O \quad v=1.49 \quad \text{equation1}$$

$$H_2O_2 \longrightarrow O_2 + 2H^+ + 2e^- \quad v=0.68 \quad \text{equation2}$$

$$2MnO_4 + 14H^+ + 5H_2O_2 \longrightarrow 2Mn^{+2} + 8H_2O + O_2 \quad \text{Delta } v=0.81 \quad \text{equation3}$$

FIG.1

CLOSED LOOP CONCENTRATION CONTROL SYSTEM FOR CHEMICAL MECHANICAL POLISHING SLURRY

BACKGROUND OF THE INVENTION

1. Field of the Invention

The present invention relates generally to a polishing slurry of chemical mechanical polishing (CMP), and more particularly to a closed loop concentration control system for polishing slurry of chemical mechanical polishing.

2. Description of the Prior Art

Integrated circuit (IC) complexity has continued to evolve, placing increasingly more demanding specifications on the processes used in their manufacture. As the requirement for increasing the density of active devices on an individual chip has escalated, the requirement for greater flatness, over long distances and short distances, on the surfaces, top and bottom, of the wafer has also evolved. Consequently, in the fabrication of integrated circuits, semiconductor substrate surface planarity is of extreme importance. In addition, flatness improves ability to fill via holes and lines through apertures in the dielectric.

Various processes have been used for planarization. One such process known as Chemical Mechanical Polishing (CMP) is presently being used in the most demanding applications. Chemical mechanical polishing (CMP) is the only technology, which can provide a total planariztion for the ultra-large scale integration (ULSI) process. This technology comes from IBM and has been developed through many decades, and been already applied on many products, such as to the central processing unit (CPU). The philosophy is the planarization technique which use a "knife grinder" like mechanical polishing method and accompanied by a proper chemical reagent to planarize the rough sketch on a wafer surface. Briefly, the Chemical Mechanical Polishing (CMP) processes involve holding and rotating a thin, flat semiconductor substrate against a wetted polishing surface under controlled chemical, pressure and temperature conditions. Once all of the parameters are properly controlled, chemical mechanical polishing can offer a smooth degree of more than 94%. The combination of mechanical and chemical removal of material during polishing results in the superior planarization of the polished surface. Therefore, semiconductor manufacturers and the suppliers of facilities and chemicals all over the world are continually investing in the development of Chemical Mechanical Polishing (CMP) technology.

During the manufacture of integrated circuits (IC) it is necessary to polish a thin wafer of semiconductor material in order to remove material and dirt from the wafer surface. Typically, a wet chemical abrasive or slurry is applied to a motor driven polishing pad while a semiconductor wafer is pressed against it in a process well known in the prior art as chemical mechanical polishing (CMP). The polishing platen is usually covered with a soft wetted material such as blown polyurethane. The polishing pad contacts the wafer surface while both wafer and pad are rotating on different axes. The rotation facilitates the transport of the abrasive containing polishing slurry between the pad and the wafer. Thus, the choice of polishing pad and slurry is determined by the material being polished, and the desired flatness of the polished surface.

Chemical Mechanical Polishing (CMP) enhances the removal of surface material over large distances and short distances by simultaneously abrading the surface while a chemical etchant selectively attacks the surface. For this purpose, Chemical Mechanical Polishing (CMP) utilizes a polishing slurry containing both an abrasive and a chemically active component. A chemical polishing slurry containing a polishing agent, such as alumina or silica, is used as the abrasive material. Necessarily, the chemical polishing slurry contains selected chemicals that etch various surfaces of the substrate during processing. Thus, the polishing effects on the wafer result from both the chemical and mechanical action.

Process reproducibility and uniformity of a Chemical Mechanical Polishing process requires periodic measurement and stringent control of the polishing slurry composition. Typically, such slurries are formulated just prior to use from an oxidant (e.g. ferric nitrate) and a particulate(e.g. alumina) dispersion. In other cases, a pre-mixed slurry may be provided. It is particularly important that careful process control is maintained over the slurry, since slurry stability may degrade over time. Part of the slurry instability can be attributed to adsorption of an oxidant onto high-surface area particles, resulting in a reduction in oxidant concentration. In addition, oxidant concentration may vary due to mixing errors and uncertainties in the original oxidant concentration used to prepare the slurry. Because oxidant concentration is one of the key parameters that control the metal removal rate (R.R) in a Chemical Mechanical Polishing process, variances in oxidant concentration may result in significant variations in the removal rates (R.R) achieved during Chemical Mechanical Polishing processes.

Consequently, it is necessary that oxidant concentration is monitored and measured during Chemical Mechanical Polishing processes. One of the conventional methods is a pre-mixing method that proceeds to mix polishing slurry (such as ssw 2000) with oxidant (such as peroxide solution; $H_2O_2$) in advance before the pre-mixing solution is carried out through titration by potassium permanganate ($KMnO_4$), so as to measure and estimate chemical concentration after being mixed. The titration equation is shown as FIG. 1, where the liquid level concentration is obtained by estimating the potential difference at that time, the calculation of the equation is that equation.1×2+equation.2×5=equation.3. Both potassium permanganate ($KMnO_4$) and the pre-mixing solution will decay in air. This method easily results in significant variations in the removal rates (R.R.) achieved during Chemical Mechanical Polishing processes. Another conventional method is the port-to-port mixing method that proceeds to mix the polishing slurry (such as ssw2000) with oxidant (such as hydrogen peroxide solution; $H_2O_2$) at the end of the polishing platen, due to the fact that the concentration of oxidant (such as peroxide solution; $H_2O_2$) is higher than one of the polishing slurry (such as ssw2000), and the quantity of oxidant (such as peroxide solution; $H_2O_2$) is less than one of polishing slurry (such as ssw2000), this method will result in pump control that is difficult. Furthermore, the conventional method cannot make up amount of oxidant at once.

In accordance with the above description, a new and improved method for controlling concentration of Chemical Mechanical Polishing (CMP) slurry is therefore necessary, so as to raise the yield and the quality of the follow-up process.

SUMMARY OF THE INVENTION

In accordance with the present invention, a method is provided for controlling the concentration of chemical mechanical polishing slurry that substantially overcomes the drawbacks of the above-mentioned problems which have arisen from the conventional methods.

Accordingly, it is an object of the present invention to provide a method for controlling concentration of chemical mechanical polishing slurry, the present invention can continuously monitor and control concentration by means of closed loop control to improve issue that can not make up amount of oxidant at once, so as to solve the above issue.

Another object of the present invention is provide that a closed loop system for controlling concentration of chemical mechanical polishing slurry, the present invention can not affect stabilization of concentration due to both of oxidant and polishing slurry can not be decayed in the ultrasonic liquid concentration analyzer. So, the present invention can determine concentration of oxidant in the volume by means of ultrasonic liquid concentration analyzer, and a fixed concentration can be obtained by it. Thus, the method of the present invention is effective in In accordance with the present invention, a closed loop system for controlling concentration of chemical mechanical polishing slurry is disclosed. In one embodiment of the present invention, first, oxidant solution (such as hydrogen peroxide), raw slurry (such as ssw2000) and deionize water (D.I water) are transported via respective piping to flow into the blend tank, and stir mixture of the above so as to form a polishing slurry. Then, the polishing slurry is transported via piping to flow into the distribution tank. Next, the polishing slurry in the distribution tank is transported via piping to flow into the closed loop concentration control system having a ultrasonic concentration detector, a analog valve, a program logic controller (PLC) and a piping controller. The polishing slurry first flows into the ultrasonic concentration detector, so as to determine the concentration through the use of instrument. Then, the piping controller controls the polishing slurry to flow into the distribution tank via backflow piping. Furthermore, the determined data of ultrasonic concentration detector is a fluid velocity at that time, this determined data can be converted into weight percent concentration at that time by using memory data table, and converted method can be operated by manual sum or computer calculation. The converted data of weight percent concentration will be transmitted into program logic controller (PLC). Portion of the polishing slurry in the distribution tank are transmitted into the blend tank through the backflow piping. Then, the polishing slurry repeat the above steps to obtain a fixed concentration, and has been continuously proceeding the above steps to keep the fixed concentration.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 show views illustrative of the equations that hydrogen peroxide ($H_2O_2$) titrate with potassium permanganate ($KMnO_4$);

DESCRIPTION OF THE PREFERRED EMBODIMENT

Although specific embodiments have been illustrated and described, it will be obvious to those skilled in the art that various modifications may be made without departing from what is intended to be limited solely by the appended claims.

Figure 2:
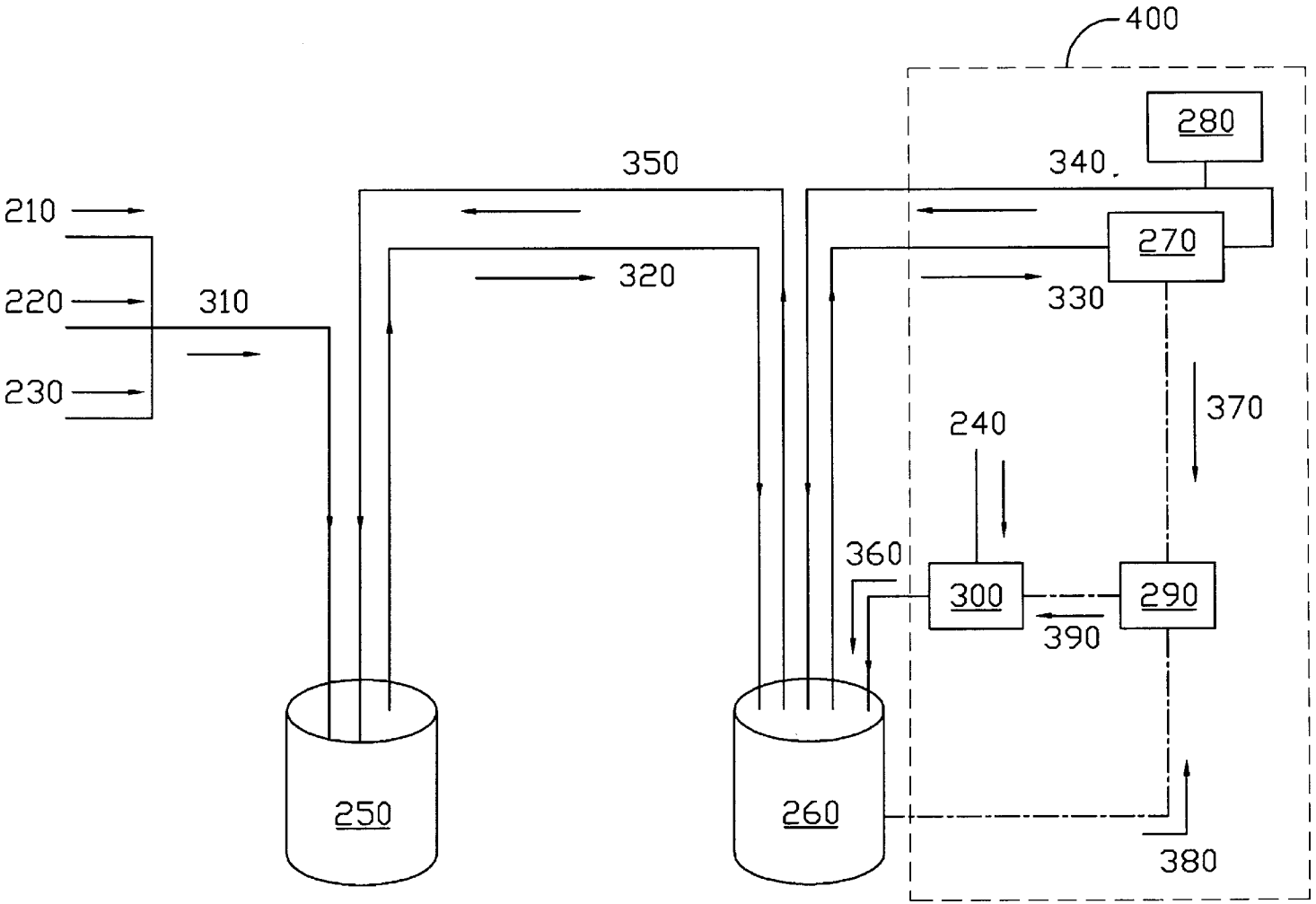
FIG. 2 show cross-sectional views illustrative of a closed loop concentration control system for chemical mechanical polishing slurry in accordance with one embodiment of the present invention.

As illustrated in FIG. 2, in this embodiment, first, a deionize water(D.I water)is transported through a first feed piping 210, oxidant solution(such as hydrogen peroxide; $H_2O_2$ 30%)is transported through a second feed piping 220, and raw slurry (such as ssw2000)is transported through a third feed piping 230 to flow into a first transportable piping 310 together to form a mixed-feed. The mixed-feed flow into blend tank 250 through first transportable piping 310 and stir the mixed-feed to form a polishing slurry. Then, the polishing slurry flows into distribution tank 260 through a second transportable piping 320.

The polishing slurry in the distribution tank 260 flow into a closed loop concentration control system 400 through a third transportable piping 330 wherein the closed loop control system 400 comprises a ultrasonic concentration detector 270, an analog valve 300, a program logic controller (PLC) 290 and a piping controller 280. The polishing slurry first flows into the ultrasonic concentration detector 270 to determine the concentration through the use of instrument. Then, the piping controller 280 controls the polishing slurry to flow into the distribution tank 260 from the ultrasonic concentration detector 270 through a fourth transportable piping 340.

Furthermore, an original data of the polishing slurry is determined by means of ultrasonic concentration detector 270 is a fluid velocity at that time, this determined value can be converted into weight percent concentration at that time by memory data table, and converted method can be operated by manual sum or computer calculation. The converted data of the weight percent concentration will be transmitted into the program logic controller (PLC) 290 via a first data transmission line 370, the data of liquid level volume in the distribution tank 260 will be simultaneously transmitted into program logic controller (PLC) 290 via a second data transmission line 380. In accordance with above data, the program logic controller (PLC) 290 will be able to analyze whether the quantity of oxidant has sufficient. If the quantity of oxidant do not reach criterion of hope, i.e. a set point for the oxidant concentration, the program logic controller (PLC) 290 will control the analog valve 300 via a third data transmission line 390 to transport the supplementary quantity of oxidant into distribution tank 260 through a sixth transportable piping 360.

Portions of the polishing slurry in the distribution tank 260 are transported into the blend tank 250 through the a fifth transportable piping 350, and the polishing slurry repeat the steps of above to obtain a fixed concentration value, such as $H_2O_2$ 4.2% wt, and it has been continuously proceeded the steps of above so as to keep the fixed concentration value.

Figure 3:
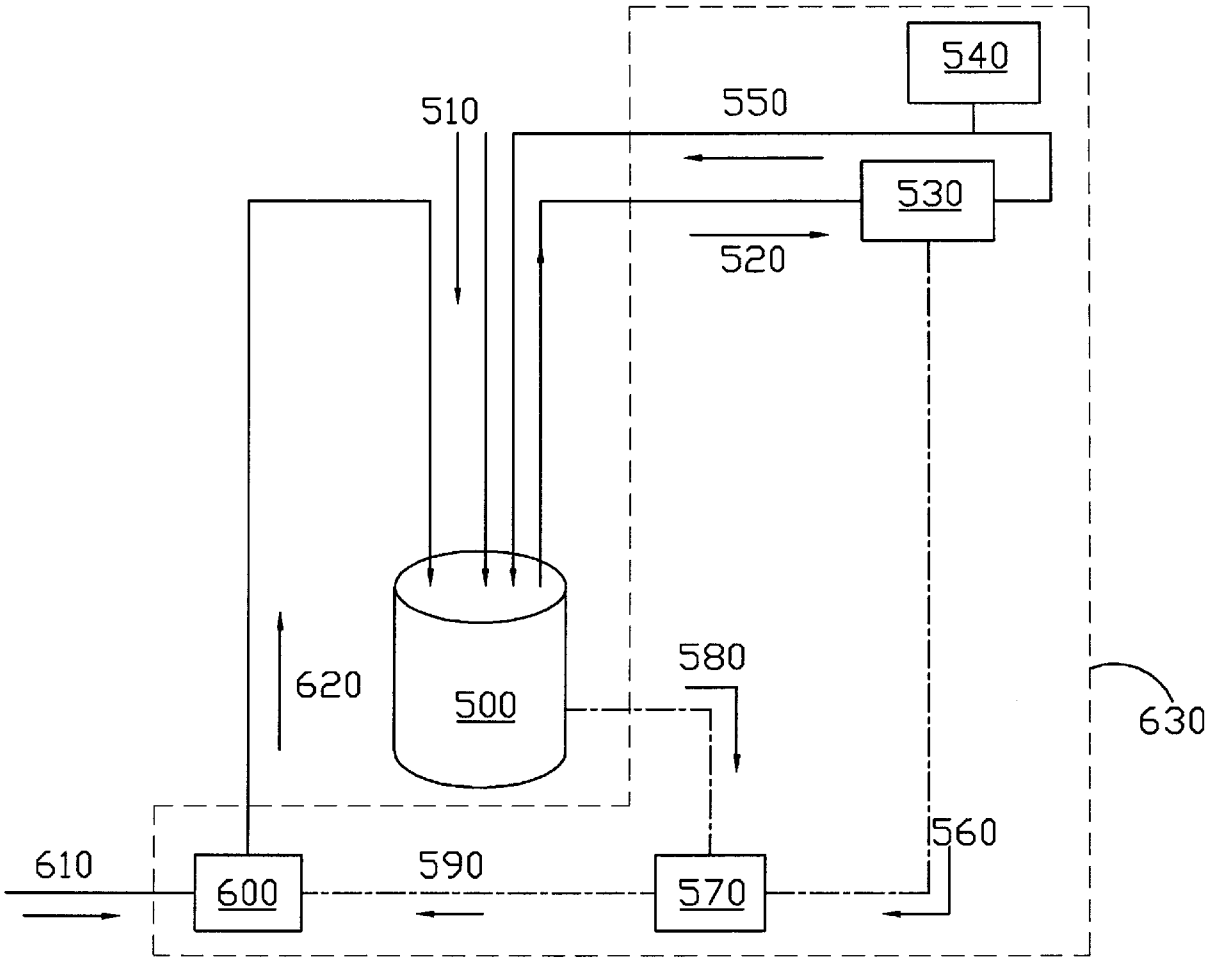
FIG. 3 show cross-sectional views illustrative of a closed loop concentration control system for chemical mechanical polishing slurry in accordance with another embodiment of the present invention.

As illustrated in FIG. 3, in this embodiment, first, a raw slurry (such as ssw2000) having an oxidant solution (such as hydrogen peroxide; $H_2O_2$ 30%) is transported through a first feed piping 510 to flow into a mixing tank 500, so as to form a polishing slurry. The polishing slurry in the mixing tank 500 flow into a closed loop concentration control system 650 through a first transportable piping 520 wherein the, closed loop control system 650 comprises a ultrasonic concentration detector 530, an analog valve 600, a program logic controller (PLC) 570 and a piping controller 540. The polishing slurry first flows into the ultrasonic concentration detector 530 to determine the concentration through the use of instrument. Then, the piping controller 540 controls the polishing slurry to flow back the mixing tank 500 from the ultrasonic concentration detector 530 through a second transportable piping 550.

Furthermore, an original data of the polishing slurry is determined by means of ultrasonic concentration detector 530 is a fluid velocity at that time, this determined value can be converted into weight percent concentration at that time by memory data table, and converted method can be operated by manual sum or computer calculation. The converted data of weight percent concentration will be transmitted into the program logic controller (PLC) 570 via a first data transmission line 560, the data of liquid level volume in the mixing tank 500 will be simultaneously transmitted into program logic controller (PLC) 570 via a second data transmission line 580. In accordance with above data, the program logic controller (PLC) 570 will be able to analyze whether the quantity of oxidant has sufficient. If the quantity of oxidant do not reach criterion of hope, a set point for the oxidant concentration, the program logic controller (PLC) 570 will control the analog valve 600 via a third data transmission line 590 to transport the supplementary quantity of oxidant into the mixing tank 500 from a second feed piping 610 through a third transportable piping 620. The polishing slurry repeat the steps discussed above to obtain a fixed concentration value, such as $H_2O_2$ 4.2% wt, and it has been continuously proceeded the steps of above so as to keep the fixed concentration value.

Figure 4:
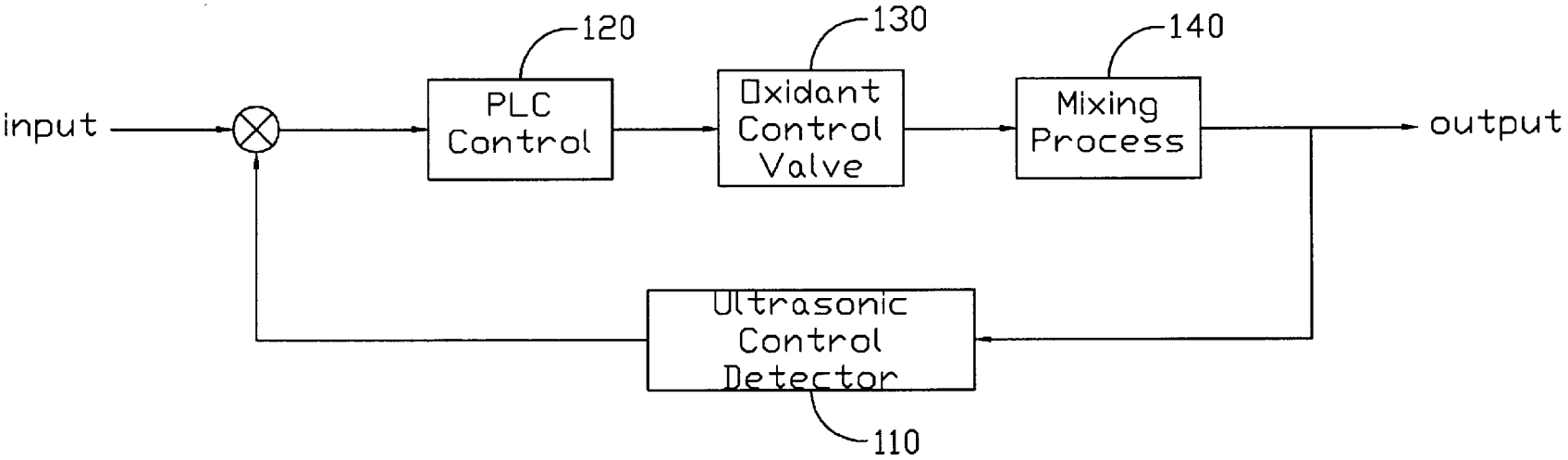
FIG. 4 show a flow chart of a closed loop concentration control system for chemical mechanical polishing slurry in accordance with one embodiment of the present invention.
Figure 5:
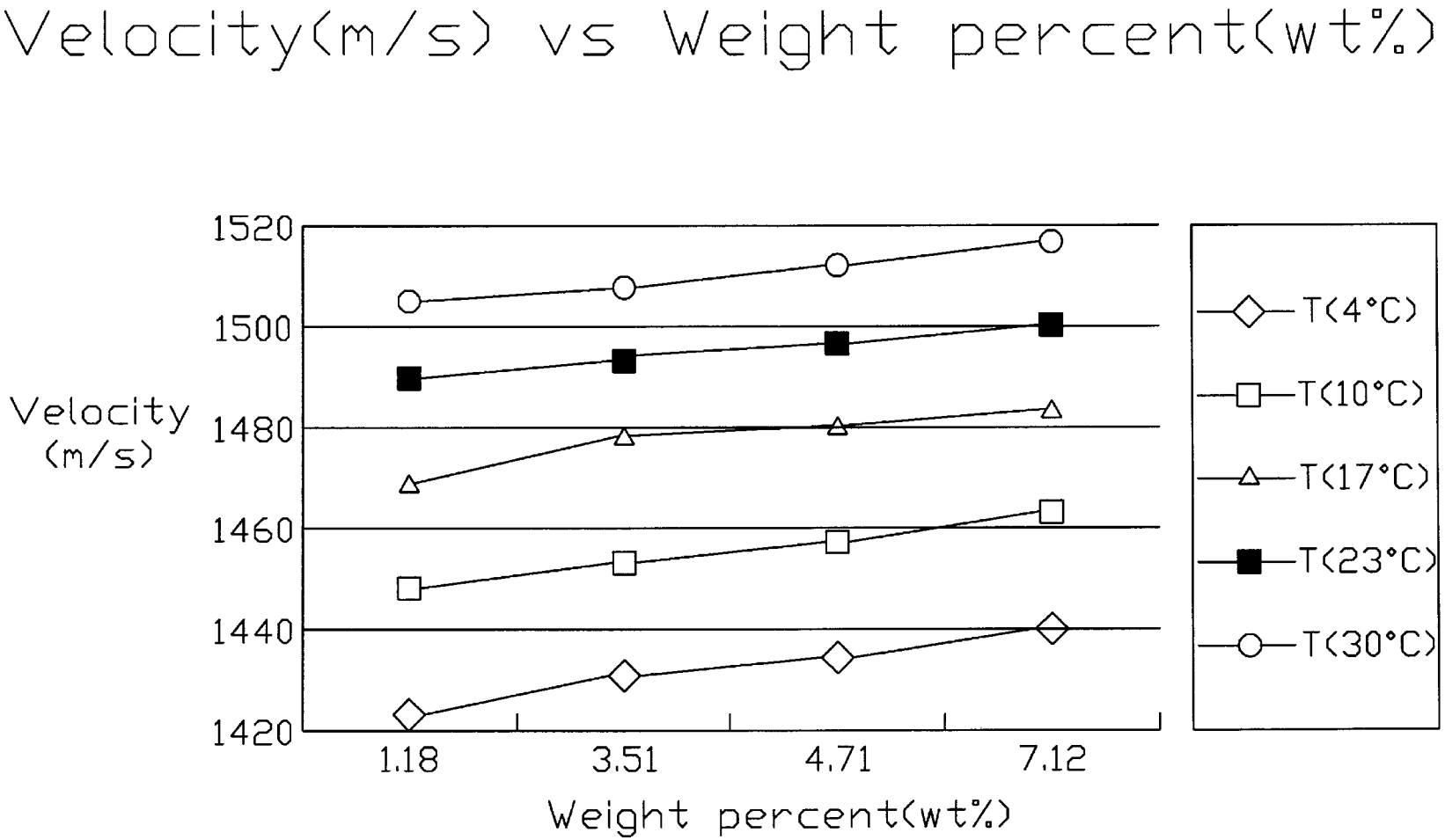
FIG. 5 show a diagram for velocity versus weight percent concentration that the data bases has stored in memory.

In this embodiment of the present invention, a closed loop concentration control system for polishing slurry of chemical mechanical polishing is provided. The flow step of the present invention is disclosed as shown in FIG. 4, herein the concentration data of oxidant which is determined by the ultrasonic concentration detector 110 will be transmitted to the program logic controller (PLC) 120. Next, the program logic controller (PLC) 120 will control oxidant control valve 130 to transport the supplementary quantity of oxidant into mixing process 140, and then the above step is repeated once again. The operative theory of the ultrasonic concentration detector is described as follows: Lv is ultrasonic velocity of fluid, and ultrasonic velocity of fluid relate with bulk modulus (B) and density (D). Hence, Lv=F (B,D). L % is weight percent concentration of fluid, and weight percent concentration of fluid relate with Lv and temperature (T) of fluid. Hence, L %=F (Lv,T). So, the data base stored in the memory can be used to calculate the concentration after measurement of the velocity and the temperature of fluid at that time, as shown in FIG. 5.

In accordance with this present invention, the polishing slurry parameters may also be automatically controlled in an on-line polishing slurry process based on measurement of the present invention. Consequently, the present invention can continuously monitor and control concentration by means of close loop control to improve issue that cannot make up the amount of oxidant at once. The stabilization of concentration will not be affected due to the fact that both of the oxidant and polishing slurry cannot be decayed in the ultrasonic liquid concentration analyzer. So, the present invention can determine the concentration of oxidant in the volume by means of the ultrasonic liquid concentration analyzer, and a fixed concentration can be obtained by it. Thus, the method of the present invention is effective in raising the quality of the process.

Obviously, many modifications and variations of the present invention are possible in light of the above teachings. It is therefore to be understood that within the scope of the appended claims, the present invention may be practiced otherwise than as specifically described herein.

What is claimed is:

1. A closed loop concentration control system for a polishing slurry for a chemical mechanical polishing process, the control system comprising:

mixing means for mixing a first feed, wherein said first feed flows into said mixing means to form a mixed fluid, wherein said first feed comprises an oxidant;

closed loop concentration control means for determining a first concentration of said oxidant in said mixed fluid, said closed loop concentration control means monitors a second feed having said oxidant flowing into said mixing means by said first concentration of said oxidant so as to compensate the concentration of said oxidant in said mixed fluid, herein said mixed fluid flows toward said closed loop concentration control means, and then said mixed fluid flows into said mixing means; and transported means for transporting said second fluid into said mixing means to mix with said mixed fluid so as to form said mixed fluid having a second concentration.

2. The method according to claim 1, wherein said closed loop concentration control means comprises:

a concentration detector having an output end and an input end, which is used to measure said first concentration of said oxidant in said mixed fluid, herein said mixed fluid flows toward said input end of said concentration detector from said mixing means;

a piping controller, which connects with said output end of said concentration detector, herein said piping controller is used to control said mixed fluid to leave said closed loop concentration control means and flow into said mixing means;

a valve having an output end and an input end, which is used to control flow of said second feed, herein said second feed flows toward said mixing means from said output end of said valve; and a program logic controller (PLC) means for receiving a concentration data, receiving a liquid level data, said program logic controller means converts said concentration data and said liquid level data into a supplementary quantity data by a table memorized in said program logic controller means to transport said second feed into said mixing means.

3. The method according to claim 2, wherein said concentration data which is received by said program logic controller (PLC) means is transmitted to program logic controller (PLC) means from said concentration detector.

4. The method according to claim 2, wherein said liquid level data which is received by said program logic controller (PLC) means is transmitted to program logic controller (PLC) means from said mixing means.

5. The method according to claim 3, wherein said supplementary quantity data of said second fluid is transmitted to said valve from said program logic controller (PLC) means.

6. A closed loop concentration control system for a polishing slurry of chemical mechanical polishing process, the control system comprising:

first mixing means for mixing a first feed, wherein said first feed flows into said first mixing means to form a first mixed fluid, and said first feed comprises an oxidant;

second mixing means for mixing a second feed and said first mixed fluid to form a second mixed fluid, herein said first mixed fluid flows toward said second mixing means from said first mixing means, and said second mixed fluid flows toward said first mixing means from said second mixing means;

closed loop concentration control means for determining a first concentration of said oxidant in said second mixed fluid, said closed loop concentration control means monitors a second feed flowing into said second mixing means by said first concentration of said second mixed fluid so as to compensate the concentration of said oxidant, herein said second mixed fluid flows toward said closed loop concentration control means from said second mixing means, and then said mixed fluid flows into said second mixing means; and transported means for transporting said second feed into said second mixing means to mix with said mixed fluid so as to form said second mixed fluid having a second concentration.

7. The system according to claim 6, wherein said closed loop concentration control system comprises:

a concentration detector having an output end and an input end, which is used to measure said concentration of said oxidant in said second mixed fluid, herein said second mixed fluid flows toward said input end of said concentration detector from said second mixing means;

a piping controller, which connects with said output end of said concentration detector, herein said piping controller is used to control said second mixed fluid to leave said closed loop concentration control means and flow into said second mixing means;

a valve having an output end and an input end, which is used to control flow of said second feed, herein said second feed flows toward said mixing means from said output end of said valve; and a program logic controller (PLC) means for receiving a concentration data, receiving a liquid level data, said program logic controller means converts said concentration data and said liquid level data into a supplementary quantity data by a table memorized in said program logic controller means to transport said second feed into said second mixing means.

8. The method according to claim 7, wherein said concentration data which is received by said program logic controller (PLC) means is transmitted to program logic controller (PLC) eans from said concentration detector.

9. The method according to claim 5, wherein said liquid level data which is received by said program logic controller (PLC) means is transmitted to program logic controller (PLC) means from said second mixing apparatus.

10. The method according to claim 7, wherein said supplementary quantity data of said second fluid is transmitted to said valve from said program logic controller (PLC) means.

11. The method according to claim 7, wherein said program logic controller (PLC) means controls said valve to transport said supplementary quantity of said second fluid into said second mixing means from said closed loop concentration control means.

12. A closed loop concentration control system for a polishing slurry for a chemical mechanical polishing process, the control system comprising:

a tank, said tank mixes a first feed to from a mixed fluid, wherein said first feed comprises an oxidant having a first concentration, and said oxidant decays to form said second concentration;

a closed loop concentration control apparatus, said closed loop concentration control apparatus determines said second concentration of said oxidant of said mixed fluid transported into said closed loop concentration control apparatus from said tank, and said closed loop concentration control apparatus calculates the requirement of said first concentration, wherein said mixed fluid flows toward said closed loop concentration control apparatus, and then said mixed fluid flows into said tank; and a transported apparatus monitored by said closed loop concentration control apparatus, said transported apparatus transport a second feed having said oxidant into said tank in accordance with the requirement of said first concentration to mix with said mixed fluid so as to compensate the decayed concentration of said oxidant.

13. The system according to claim 12, wherein said first feed further comprises a polishing slurry and deionized water.

14. The system according to claim 13, wherein said oxidant comprises a hydrogen peroxide solution.

15. The system according to claim 12, wherein said closed loop concentration control means comprises:

a concentration detector having an output end and an input end, which is used to measure said second concentration of said oxidant to form a concentration data, herein said mixed fluid flows toward said input end of said concentration detector from said tank;

a piping controller, which connects with said output end of said concentration detector, herein said piping controller is used to control said mixed fluid to leave said closed loop concentration control apparatus and flow into said tank;

a valve having an output end and an input end, which is used to control flow of said second feed, herein said second feed flows toward said tank from said output end of said valve; and a program logic controller (PLC) means for receiving said concentration data from said concentration detector, receiving a liquid level data from said tank, calculating a supplementary quantity data of said second feed by a table for converting said concentration data and said liquid level data into said supplementary quantity data, wherein said program logic controller means controls said valve by said supplementary quantity data to transport said second feed from said transported apparatus into said tank.

16. A closed loop concentration control system for a polishing slurry for a chemical mechanical polishing process, the control system comprising:

a first tank, said first tank mixes a first feed to form a mixed fluid, wherein said first feed has a polishing slurry, dinoize water and an oxidant having said first concentration, said first concentration decays to form a second concentration;

a second tank, said mixed fluid is transported into said second tank from said first tank, and said second tank determines a liquid level data of said mixed fluid;

a closed loop concentration control apparatus, said closed loop concentration control apparatus determines said second concentration of said oxidant of said mixed fluid transported into said closed loop concentration control apparatus from said second tank, and said closed loop concentration control apparatus calculates the requirement of said first concentration, wherein said mixed fluid flows toward said closed loop concentration control apparatus, and then said mixed fluid flows into said second tank; and a transported apparatus monitored by said closed loop concentration control apparatus, said transported apparatus transports a second feed into said second tank in accordance with the requirement of said first concentration to mix with said mixed fluid so as to compensate the decayed concentration of said oxidant, wherein said second feed has said oxidant, and said mixed fluid is transported into said first tank.

17. The system according to claim 16, wherein said oxidant comprises a hydrogen peroxide solution.

18. The system according to claim 16, wherein said closed loop concentration control means comprises:

a concentration detector having an output end and an input end, which is used to measure said second concentration of said oxidant of said mixed fluid to form a concentration data, herein said mixed fluid flows toward said input end of said concentration detector from said second tank;

a piping controller, which connects with said output end of said concentration detector, herein said piping controller is used to control said mixed fluid to leave said closed loop concentration control apparatus and flow into said second tank;

a valve having an output end and an input end, which is used to control flow of said second feed, herein said second feed flows toward said second tank from said output end of said valve; and a program logic controller means for receiving said concentration data from said concentration detector, receiving said liquid level data from said tank, calculating a supplementary quantity data of said second feed by a table for converting said concentration data and said liquid level data into said supplementary quantity data, wherein said program logic controller means controls said valve by said supplementary quantity data to transport said second feed from said transported apparatus into said second tank.

* * * * *